United States Patent [19]

McCoy, Jr.

[11] 4,441,025

[45] Apr. 3, 1984

[54] PROTECTIVE DEVICES

[76] Inventor: William J. McCoy, Jr., 41 Balsey Rd. South, Stamford, Conn. 06902

[21] Appl. No.: 282,868

[22] Filed: Jul. 13, 1981

[51] Int. Cl.[3] ..... G21F 3/02

[52] U.S. Cl. ..... 250/516.1; 250/519.1; 2/2.5; 2/51

[58] Field of Search ..... 250/516, 519; 2/2 R, 2/2.5, 48, DIG. 6, DIG. 7, 51, 52, 92, 49 R; 224/153, 260–262; D2/226–229; D3/32; 128/379

[56] References Cited

U.S. PATENT DOCUMENTS

| | | | |
|---|---|---|---|
| D. 80,474 | 2/1930 | Baker | 2/48 X |
| D. 173,089 | 9/1954 | Reich | D3/32 |
| 1,632,873 | 6/1927 | Bliss | 2/48 |
| 1,839,262 | 1/1932 | Quinn | 2/48 |
| 2,404,225 | 7/1946 | Green | 250/516 |
| 2,451,282 | 10/1948 | Feibel | 250/516 |
| 2,494,664 | 1/1950 | Lubow | 250/516 |
| 2,642,542 | 6/1953 | Weinberg | 250/516 |
| 3,052,799 | 9/1962 | Hollands | 250/516 |
| 3,093,829 | 6/1963 | Maine | 250/516 |
| 3,233,248 | 2/1966 | Bushnell | 250/516 |
| 3,946,916 | 3/1976 | Lawrence | 224/262 |
| 3,996,620 | 12/1976 | Maine | 2/48 |
| 4,013,201 | 3/1977 | Potter | D3/32 |
| 4,114,788 | 9/1978 | Zufich | 224/153 |
| 4,196,355 | 4/1980 | Maine | 250/516 |

FOREIGN PATENT DOCUMENTS

| | | | |
|---|---|---|---|
| 1078279 | 3/1960 | Fed. Rep. of Germany | 250/516 |
| 1145614 | 10/1957 | France | 250/516 |
| 744092 | 2/1956 | United Kingdom | 2/51 |

OTHER PUBLICATIONS

"Webster's Third New International Dictionary of the English Language Unabridged", G. & C. Merriam Co., Mass., 1961.

Rubin, "A Protective Apron for Users of $^{32}P$", Health Physics 39, (3), Sep. 1980, pp. 574–576.

*Primary Examiner*—Alfred E. Smith

*Assistant Examiner*—Carolyn E. Fields

*Attorney, Agent, or Firm*—William G. Rhines

[57] ABSTRACT

This invention relates to protective apparel for the human body, and in one embodiment comprises an x-ray protective apron having a main body portion and securing flaps to be wrapped around the body to secure the apron in place. The securing flaps are located approximately in the region of the small of the back when in the securing position and are characterized by being variable as to degree of tightness and by being oriented with their outermost ends in a downward direction when in the secured position, thereby effecting fastening of the apron to the body and varying weight distribution of the apron as between the wearer's shoulders and lower back.

6 Claims, 4 Drawing Figures

PROTECTIVE DEVICES

BACKGROUND OF INVENTION

Frequently, it is desired to have protective apparel for human use. Typically, such apparel may be so weighty as to be, or become with extended use, burdensome and tiring to the wearer. This is particularly true when the weight of the apparel is borne primarily and/or unremittantly by the wearer's shoulders. For example, persons exposed to x-rays typically wear aprons and/or other apparel made from material having a large lead and/or other heavy metal content, designed to absorb harmful radiation to which the user might otherwise be exposed. Such aprons may weigh in the range of about 8 to about 25 pounds. Since users, such as x-ray technicians, radiologists, etc. frequently have to wear them for extended periods of time, they often become tiring and even painful, particularly when the sole or primary support is substantially or constantly one portion of the wearer's body. The shoulders, because of their physiological structure and their relatively high position on the body as a whole, are particularly susceptable to these effects.

Accordingly, it is an object of this invention to provide means for selectively distributing the weight of heavy protective apparel.

Another object is to provide such means in a form which is adaptable for use by different persons whose body size and volumetric distribution differs from that of other users.

Still another objective is to provide means satisfying the foregoing objective which are inexpensive and readily adaptable to standard apparel production equipment and methods.

SUMMARY OF INVENTION

Desired objectives may be achieved through practice of the present invention, embodiments of which include protective apparel having fastening flaps which cross across the lower portion of the wearer's back and fasten, selectively as to length and therefore tautness, with their outermost ends secured to the main body of the apparel in a position which is deflected downward.

DESCRIPTION OF DRAWINGS

This invention may be understood from the description presented and from the accompanying drawings in which.

DESCRIPTION OF PREFERRED EMBODIMENTS

Radiation protective aprons, per se, are known. In this connection, reference is made to U.S. Pat. Nos. 3,404,225 (Green); 2,451,282 (Feibel); 2,494,664 (Lubow); 2,642,542 (Weinberg); 3,052,799 (Hollands); 3,093,829 (Maines); 3,233,248 (Bushnell); and German Pat. No. 1078279 and French Pat. No. 1145614.

Figure 1:
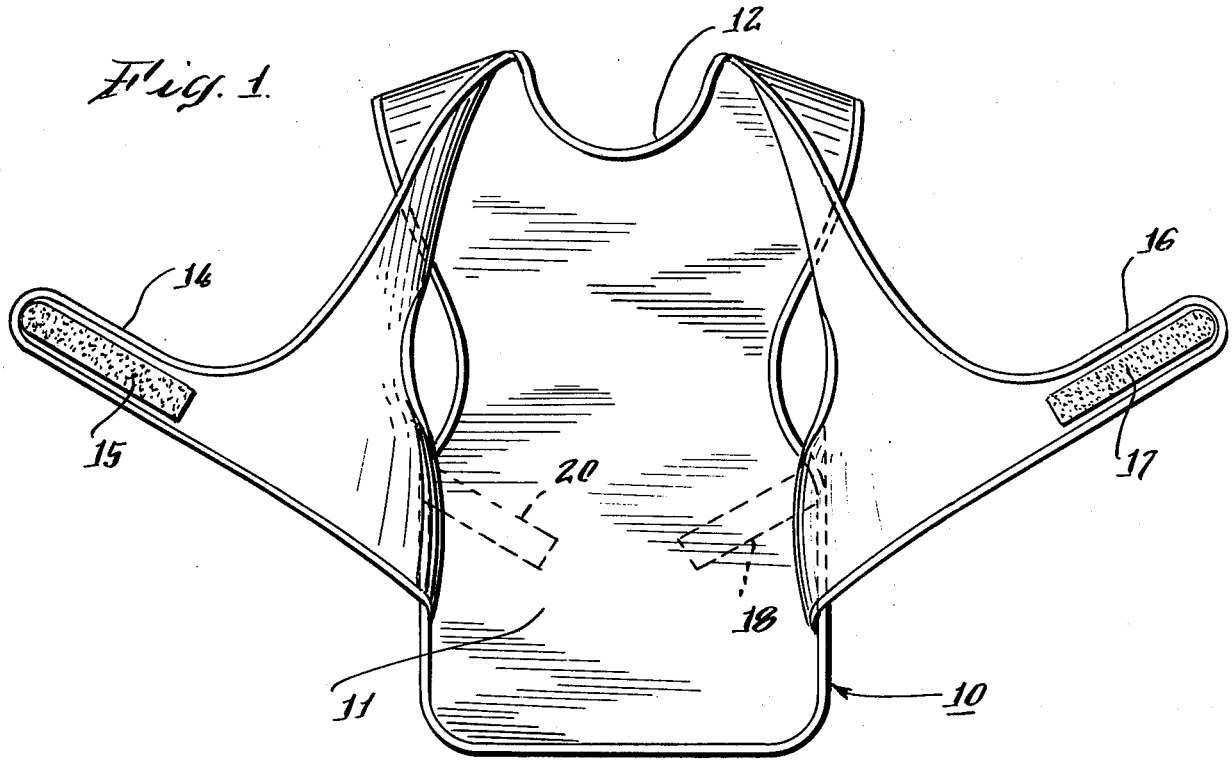
FIG. 1 depicts an embodiment of this invention in plan view.

Referring first to FIG. 1, there is depicted, laid out flat, in a plan view, an x-ray protective apron 10 which embodies the present invention. Although this particular embodiment will be discussed at length here, it is to understood that this invention is not restricted to this particular embodiment or use, but instead is applicable to any apparel. Thus, for example, it is not restricted to use on x-ray protective equipment, but is applicable as well to equipment for use in protecting against other forms of radiation, as well as for such things as bulletproof vests and the like, particularly where the weight of the equipment is a significant factor.

The apron apparel shown in FIG. 1 may be made from a wide variety of known per se protective materials, such as lead filled vinyl, laminated fabrics, etc. As shown, it includes a main body portion 11, a neck portion 12, and flap members 14, 16. The insides of the flaps 14, 16, (i.e., the portions which ultimately face juxtaposed to the outer surface of the apron) include Velcro surfaces 15, 17 (respectively), for interengagement with the Velcro surfaces 18, 20 (respectively) affixed to the front of the main body 11 of the apron 10. Although other forms of length (and therefore tautness) adjustable fasteners, such as hooks and eyes (not shown) may also and/or alternatively be used, Velcro fasteners have been found to be particularly advantageous for use with embodiments of this invention because of the ease with which they may be attached and removed, and because of the small and variable increments of length adjustment which they afford, as contrasted with the more limited and fixed positioning afforded by other fastening means. In this connection, reference is made to Maines U.S. Pat. No. 4,196,355.

It should be noted particularly that in preferred embodiments of this invention, the flaps are so that, and the corresponding fastener means 18, 20 on the main body 11, are so oriented that when the flaps 14, 16 are fastened in position as hereinafter described, their outermost ends, and therefore their axial orientation, will be at least slightly downward. By this means, the weight transfer hereinafter described, may be achieved easier and more effectively as this tends to transfer the apron's weight downward onto the pelvis, rather than straight across the small of the back.

Figure 2:
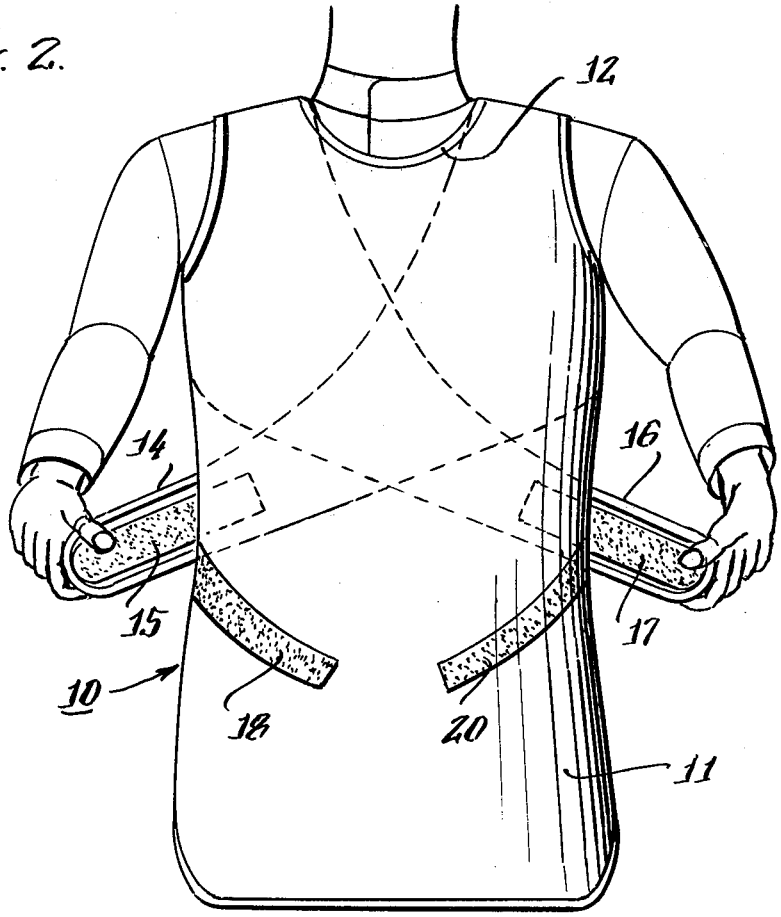
FIG. 2 depicts the embodiment of this invention shown in FIG. 1 as it is being put on by a user.
Figure 3:
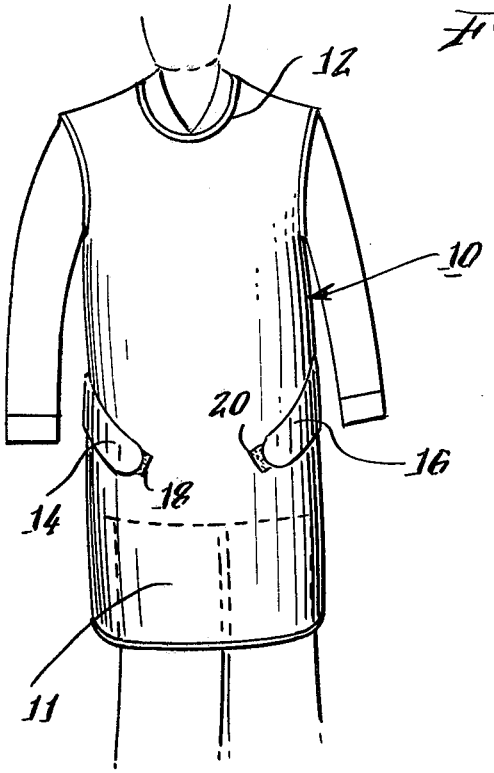
FIG. 3 depicts a front view of the embodiment of this invention shown in FIG. 1 after having been put on by a user.
Figure 4:
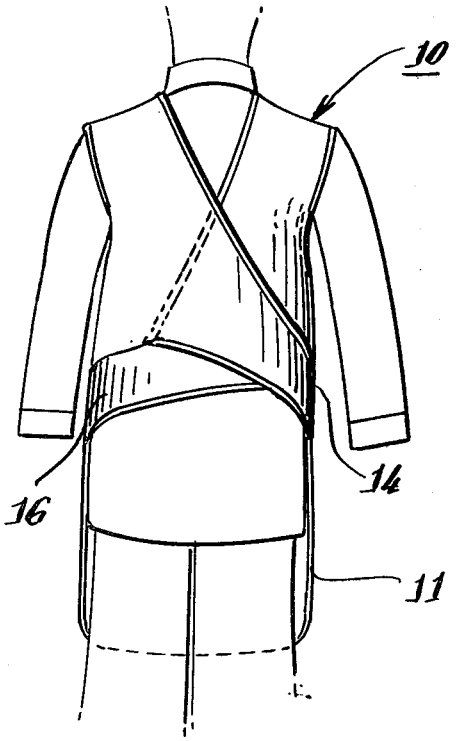
FIG. 4 depicts a rear view of the embodiment of this invention shown in FIG. 1 after having been put on by a user.

Referring to FIG. 2, it will be seen that when the user puts the apron on, the flaps 14, 16 are crossed approximately in the region of the lower back; i.e., near the top of the pelvis structure, where the size of the body normally increases above the buttocks. The user has virtually unlimited choice as to the degree of length of the flaps as they are brought around the sides and, as shown in FIG. 3, secured to the front of the apron by means of the associated fastening means. It will be apparent, therefore, from FIG. 4 in particular, that by means of so regulating the length of the flaps, and therefore their degree of tautness, part or even substantially all of the weight of the apron may be taken off of the wearer's shoulders and concentrated on the wearer's lower body region. The looser the flaps, the greater the share of the weight that will be borne by the shoulders. The tighter the flaps are drawn, the greater the share of the weight that will be borne by the lower body region; i.e., the hips and pelvis. The latter, structurally as well as by virtue of being at a lower center of gravity, is more well suited for weight bearing, particularly over extended periods of time. Another feature of this, in terms of user comfort, is the ready ability which it affords to change the weight distribution of the apron at any time and from time to time; such change, per se, being well known as a means to make weight bearing more tolerable and comfortable, particularly over extended periods of time.

Thus, it will be apparent that through practice of this invention, it is possible to produce a wide variety of apparel which is as fully protective as desired, of "full" cut and adaptably contoured, roomy, non-binding, and yet, even when made from heavy materials, adjustable so as to redistribute its weight and to minimize fatigue.

Accordingly, it is to be understood that the embodiments herein disclosed and described are by way of illustration and not of limitation, and that a wide variety of embodiments may be made without departing from the spirit or scope of this invention.

I claim:

1. A protective apparel device comprising a main body portion having support straps in the shoulder region thereof, and means to selectively distribute the weight of said device by transfering its weight selectively between the lower body region and the shoulder region of the user, said means comprising flaps integral with said main body portion for securing said apparel to the body of the user, said flaps being characterized by being adapted to cross in the region of the lower back of the user, having fastening means at their outermost ends for removeable affixation to said main body in selected positions of extension of said flaps about the body of the user with corresponding changes in the degree of tension on said flaps, and being oriented downward at their outermost ends when affixed to said main body.

2. The device described in claim 1 wherein said fastening means is a Velcro fastener.

3. The device described in either of claims 1 or 2 made from material which is protective against x-ray radiation.

4. The device described in either of claims 1 or 2 comprising an apron.

5. The device described in either of claims 1 or 2 comprising an apron made from material which is protective against x-ray radiation.

6. A protective apron comprising a main body portion having shoulder support straps, securing flaps integral with said main body which cross in the region of the lower back of the user when in normal use with the outermost ends thereof removeably affixed to the front of said main body in a generally downward orientation, and means for so removeably affixing said flaps to said main body in selectively variable positions of extension about the body of the user to increase the degree of extension of said flaps about the body of the user to cause the weight of said apron to be increasingly transferred from the shoulders of the user to the lower body region.

* * * * *